US005996682A

United States Patent [19]

Cai et al.

[11] Patent Number: 5,996,682

[45] Date of Patent: Dec. 7, 1999

[54] METHOD OF MAKING A MOLD FOR METAL CASTING

[75] Inventors: Mei Cai, Sterling Heights; June-Sang Siak, Troy; Richard Michael Schreck, Bloomfield Hills; Nicholas Edward Sargent, Canton, all of Mich.

[73] Assignee: General Motors Corporation, Detroit, Mich.

[21] Appl. No.: 09/047,187

[22] Filed: Mar. 9, 1998

[51] Int. Cl.[6] ..... B22C 7/02; B22C 9/04

[52] U.S. Cl. ..... 164/516; 164/36; 164/44; 164/132

[58] Field of Search ..... 164/45, 34, 36, 164/131, 132, 516, 44

[56] References Cited

U.S. PATENT DOCUMENTS 4,824,570 4/1989 Bethuel et al. ..... 210/511

5,860,467 12/1996 DeSimone et al. ..... 164/5

*Primary Examiner*—Kuang Y. Lin

*Attorney, Agent, or Firm*—George A. Grove

[57] ABSTRACT

A mold for a prototype metal casting or the like may advantageously be made by forming a casting pattern of adhesively bonded aggregate particles using a binder containing a principle constituent that is soluble in supercritical carbon dioxide; forming a rigid shell mold about the pattern of materials that are unaffected by supercritical carbon dioxide; thereafter exposing the pattern and mold combination to supercritical carbon dioxide to remove the pattern binder adhesive and leave unbonded aggregate particles in the mold and removing the aggregate particles from the mold to leave a mold cavity that faithfully defines the pattern shape.

7 Claims, 4 Drawing Sheets

METHOD OF MAKING A MOLD FOR METAL CASTING

TECHNICAL FIELD

This invention relates to an efficient and low cost method of making a small number of molds for metal casting. More specifically this invention relates to a method of making patterns and molds, especially for the casting of a relatively low number of parts such as parts for prototype evaluation.

BACKGROUND OF THE INVENTION

There is a continuing need for a low cost method of forming a single casting or a relatively few castings such as may be required for prototype parts or for very low volume production. There have been developed a number of prototype-making processes that yield plastic parts or synthetic resin-coated aggregate parts that are built up, section by section, by a controlled scanning laser beam that polymerizes a layer of molten plastic or fuses a layer of polymeric film coated aggregate particles. However, there is no low cost method for making a single mold or relatively few molds for making a few cast metal parts.

As stated, it is known to coat ceramic particles or sand particles, glass beads or the like with a suitable fusible polymer film for the purpose of building a prototype part of such materials. In this practice, a flat surface is usually dusted or coated with a number of such particles, and a computer-controlled laser beam sweeps back and forth over the particles selectively heating those that are to be fused together to constitute a particular layer or planar section of the part to be fused together. The work surface or stage carrying the flat section is then lowered by the thickness of a particle layer, a new layer of particles applied, and the process of fusing the new layer of particles with the laser beam is repeated. In this way of forming successive layers of bonded particles or polymerized monomers, virtually any shape of a prototype part can be formed. However, the part is representative only of the shape of the adhesive bound particles and cannot represent all properties of a desired cast metal part. Furthermore, such prior art prototypes could not be used as casting patterns because they were not strong enough to form a two-part mold around them and they could not be easily removed from such a mold.

It is an object of this invention to provide a method of making a pattern and mold for the production of one or a few metal castings.

SUMMARY OF THE INVENTION

This invention utilizes novel adhesive or binder film compositions for the purpose of building up a casting pattern of resin-bonded aggregate particles. The resin-bonded, particulate pattern is unique in that the composition of the adhesive, binder film is sufficiently soluble or extractable in carbon dioxide fluid at a supercritical temperature and pressure to remove the adhesive film from the pattern and to disintegrate the particulate mass into flowable individual particles. This unique carbon dioxide degradable particulate casting pattern (including the part and any casting sprues or resins) is encased in a conventional rigid shell mold that is not susceptible to degradation by supercritical carbon dioxide fluid. In this way, a pattern is made by modern, computer-controlled laser beam scanning and heating prototype methods. A suitable mold, e.g., a shell mold, is then formed about the temporary pattern. The pattern is disintegrated within an otherwise unaffected mold by exposure to supercritical carbon dioxide fluid.

An important aspect of the invention which enables the particulate pattern to be formed is the use of a two-constituent binder composition, one constituent of which is soluble in supercritical carbon dioxide and the other constituent, which provides the strength of the adhesive film, is not soluble in supercritical carbon dioxide. Furthermore, the viscosity of the two-constituent binder composition is suitable for coating the aggregate particles and bonding them together. An example of binder constituents that are soluble in supercritical carbon dioxide are the compounds naphthalene and diphenyl carbonate. Examples of binder materials that can be mixed with diphenyl carbonate and/or naphthalene to form a temporary binder include relatively low molecular weight polystyrenes (molecular weight of about 1000 to 5000) or relatively high molecular weight polyethylene glycols, suitably those glycols having a molecular weight in the range of 2000 to 20,000. These binder constituents that are mixed with diphenyl carbonate or naphthalene to provide adhesive strength and binder viscosity are not soluble in supercritical carbon dioxide fluid.

Thus, in the practice of the invention, a mixture of, for example, diphenyl carbonate and polyethylene glycol of suitable molecular weight is formed. Preferably the mixture contains at least 50% by weight of diphenyl carbonate (m.w. 214). Melted diphenyl carbonate provides little strength, integrity or viscosity to the adhesive. The polyethylene glycol is relied upon for the strength of the adhesive. However, diphenyl carbonate is soluble in supercritical carbon dioxide fluid and is an essential ingredient of the binder for pattern removal purposes.

Particles of aggregate materials such as lake sand, zircon sand, glass beads or the like are coated with a film of the diphenyl carbonate and polyethylene glycol mixture. The binder mixtures makes up 5–15% by weight of the coated particles. The particles are sized to provide suitable surface smoothness. The binder mixture may be dissolved in hot water or methylene chloride, toluene or the like and mixed with the mass of particles to wet each one and to provide each particle with a film of the special adhesive.

A pattern of an article to be cast may then be formed, e.g., utilizing the now-conventional computer-controlled, scanning laser beam prototype practice in which one layer at a time of adhesive-coated aggregate particles are scanned and selectively heated with the laser beam to momentarily fuse the diphenyl carbonate-containing adhesive film and bond together those particles which form a layer of the article to be produced. That layer is lowered and a new coating of adhesive-coated but unbound particles is swept over the formed section and the treatment with the laser beam repeated. Successive layers of bound particles are thus formed, each layer being joined to the underlying layer so that a suitable prototype pattern configuration may be formed. In a simple example, the part to be formed may be simply a solid cylinder, for example.

Inclusion in the binder mixture of the relatively high molecular weight polyethylene glycol provides enough binder strength to the pattern to enable a particulate shell mold to be formed about the pattern. The shell mold may comprise lake sand or zircon particles which are fused together by an adhesive film that is not soluble in supercritical carbon dioxide. Examples of such a binder include a composition known as GMBOND™ or water-based glues such as methylcellulose or modified starch pastes. GMBOND™ comprises gelatin as a binder material. The gelatin binder serves to suitably form a strong and rigid shell mold about the removable pattern.

The pattern-shell mold combination is then placed in a chamber where the combination is exposed to supercritical carbon dioxide fluid suitably at a temperature of about 35° C. and a pressure above 1100 psi. The supercritical carbon dioxide fluid readily permeates both the particulate shell mold and the particulate pattern. However, the fluid selectively dissolves or extracts the diphenyl carbonate (or naphthalene) constituent of the pattern binder. The flow of the carbon dioxide fluid extracts the total pattern binder mixture from the pattern aggregate. This binder mixture is carried to a separate compartment of the extraction apparatus by the flow of the carbon dioxide. There, the $CO_2$ is vaporized from the binder mixture for separate recovery.

Upon completion of the extraction process, the pattern particles are no longer bonded to each other but constitute a flowable mass that may be drained by gravity from the shell mold. The shell mold then defines a cavity for metal casting to be produced and any desired metal alloy, such as aluminum alloys, steel alloys, cast iron and the like, may be cast in the thus produced, suitably supported shell mold.

Thus, this invention provides a low cost and effective method of producing a mold or a few molds for the casting of a single prototype part or a relatively few numbers of parts. It is faster and cleaner than scanning the prototype part in polycarbonate plastic and forming an investment casting mold of some heat-resistant material like plaster of Paris and then heating the combination to burn out the plastic prototype. This invention is also an environmentally clean practice. The binder composition is recovered in the carbon dioxide and can be reused. The carbon dioxide can be recompressed and reused. The aggregate particles used to form the casting pattern can also be reused.

These and other objects and advantages of the invention will become more apparent from a detailed description thereof which follows.

DESCRIPTION OF A PREFERRED EMBODIMENT

Figure 1:
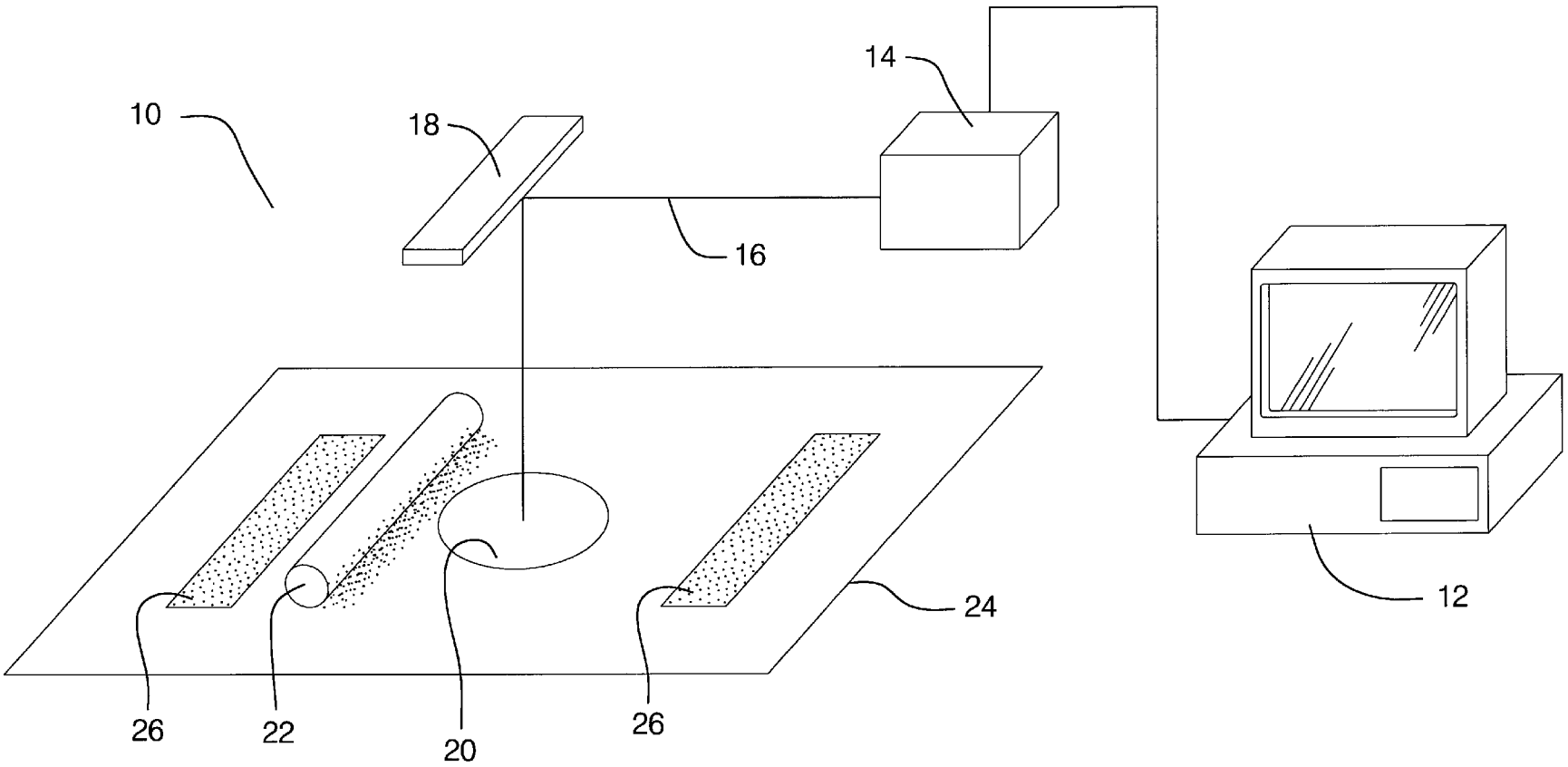
FIG. 1 is a schematic view of a laser beam scanning a layer of binder coated aggregate particles to selectively bond a portion of the particles in the cross-sectional configuration of an exemplary spool-shaped cylindrical part.

This invention provides a method of rapidly, efficiently and inexpensively making metal casting patterns and molds. In addition to being efficient, the method is environmentally clean in that the pattern making materials are benign and can be recovered for repeated usage.

The invention is based upon and utilizes a binder composition comprising a first constituent that is soluble in a supercritical fluid such as carbon dioxide and a second constituent that is not soluble in that supercritical fluid but provides suitable binder strength to the binder mixture. It is preferred to employ carbon dioxide as the supercritical fluid binder extracting medium and the binder compositions disclosed in this specification are selected for their utility with the use of carbon dioxide.

A preferred ingredient of the binder which is soluble in supercritical carbon dioxide is diphenyl carbonate. This organic compound (molecular weight 214 and m.p. 80° C.) is employed for its solubility in supercritical carbon dioxide fluid and its miscibility with suitable binders. Diphenyl carbonate preferably constitutes 50% or more by weight of the binder mixture. Naphthalene is also suitable for use as the $CO_2$ supercritical fluid (SCF) soluble binder constituent.

The second constituent of the binder is a material that adds strength and adhesiveness to the composition but is insoluble in supercritical carbon dioxide. The mixture of this second constituent with the $CO_2$ soluble constituent provides the melted mixture with a suitable viscosity, preventing it from flowing by capillary action away from the region of aggregate being heated by the laser (see FIG. 5) to assure high definition in the final part. Examples of such materials are low molecular weight polystyrene, polyethylene glycol (PEG), especially PEG having a molecular weight in the range of 2000 to 20,000. A suitable PEG is a preferred constituent for use with the diphenyl carbonate or naphthalene. Examples of suitable mixtures are mixtures comprising 50% by weight diphenyl carbonate and 50% by weight of a polyethylene glycol having a molecular weight of about 3400. Another example of a suitable adhesive formulation is one consisting of 80% by weight diphenyl carbonate and about 20% by weight of a polyethylene glycol having a molecular weight of about 8000. The diphenyl carbonate and polyethylene glycol are simply mixed together and melted at about 80° C. to 100° C. to form a uniform mixture of the two ingredients. Obviously, additional resinous material may be employed or even two or more polyethylene glycols of different molecular weights.

In accordance with the invention, a pattern for the mold making is prepared by bonding together binder-coated particles of a suitable aggregate material. Examples of suitable aggregate materials are particles of lake sand, zircon sand, or solid or hollow glass beads. Any suitably fine particulate material which is inert with respect to the adhesive binder and to the processing steps of this invention may be employed. Usually, it is preferred to use appropriately fine grain particles depending upon the desired surface finish of the pattern to be made.

A suitable volume of the aggregate particles are each individually coated with the adhesive binder composition. This is accomplished by dissolving the diphenyl carbonate-polyethylene glycol mixture, for example, in a suitable solvent such as methylene chloride, ethanol or toluene and mixing the aggregate particles with the solution to coat the individual particles. The binder will suitably constitute about 5 to 15 percent by weight of the coated particles. The solvent is then evaporated to leave a residual film of the polyethylene glycol-diphenyl carbonate mixture on each particle. The binder film suitably melts, typically at a temperature of about 60° C. to 90° C. The particles can be bonded together by any suitable practice simply by forming a mass of the particles into a desired shape, heating the particles to a temperature to temporarily melt the adhesive binder, and then cooling the mixture to allow the binder to resolidify, bonding all the particles together in a suitable configuration.

Figure 2:
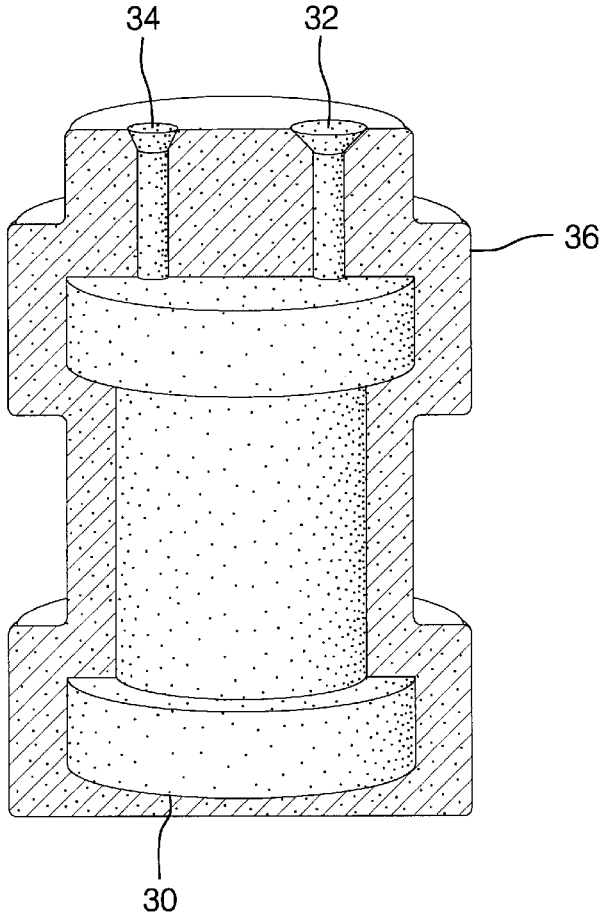
FIG. 2 is a schematic view, partly in section and broken away, showing a finished pattern of a desired part encased in a shell mold in accordance with the invention.

A particularly preferred way to bond the particles together is to use a conventional laser scanning, numerically controlled, rapid prototyping apparatus. The use of such apparatus 10 in forming a pattern in accordance with this invention is illustrated schematically in FIG. 1. A computer software representation of the part to be made and thus the pattern to be made is prepared. The programmed computer 12 directs a laser 14 and beam 16 with optics/mirrors 18 to systematically scan a desired cross section for each cross-sectional layer 20 of the pattern to be produced. The programmed computer also controls the spreading of the binder-coated particles in the layer to be heated. Equipment to perform such operation is commercially available—for example, the DTM Sinterstation 2000 with a 50 watt $CO_2$ laser. Each layer of the part from one end to the other is formed sequentially by rolling 22 a layer of binder coated, granular aggregate material across a surface which will be exposed to the laser beam. The laser beam scans those regions of the surface which will be transformed into the section of the part then being formed. The scanning of the relatively low power laser (for example, a carbon dioxide laser) momentarily melts the adhesive binder, permitting adjacent particles to be fused together. Once a section has been scanned and the particles therein to be joined are bound together, that surface is lowered below platform 24 and a new layer of particles from reservoirs 26 swept over the formed surface. The laser scanning and particle bonding procedure is repeated. This practice is repeated until all sections of the prototype part have been sequentially formed. At the completion of the laser scanning process, any unbonded particles can be shaken off or dusted out of the part and a suitably strong pattern of the part to be cast remains. The combination of diphenyl carbonate and the polyethylene glycol provides sufficient binder strength for the formation of a shell mold around the part pattern (30 in FIG. 2) in order for the mold to be built up. The laser scanning prototyping operation preferably is employed to form not only the part portion of the pattern but a sprue 32 or riser 34 required for a casting process.

The casting pattern is then used as a basis for the formation of a surrounding mold structure 36. Any suitable mold making practice may be employed. Preferably, a shell mold is formed. It may be preferable, for example, to use lake sand or zircon sand which has been coated with a relatively new binder formulation called GM BOND™. GM BOND™ utilizes gelatin with certain ferric oxide ingredients as the binder. Again, the gelatin with suspended ferrite particles can be dissolved in water and the solution used to treat the sand particles to provide them with an adhesive binder. The moistened particles are then laid up over the previously made casting pattern and dried so that a suitably strong and rigid shell mold structure is built up over the pattern. A mold structure 36 is illustrated in section in FIG. 2 of the drawings.

Figure 3:
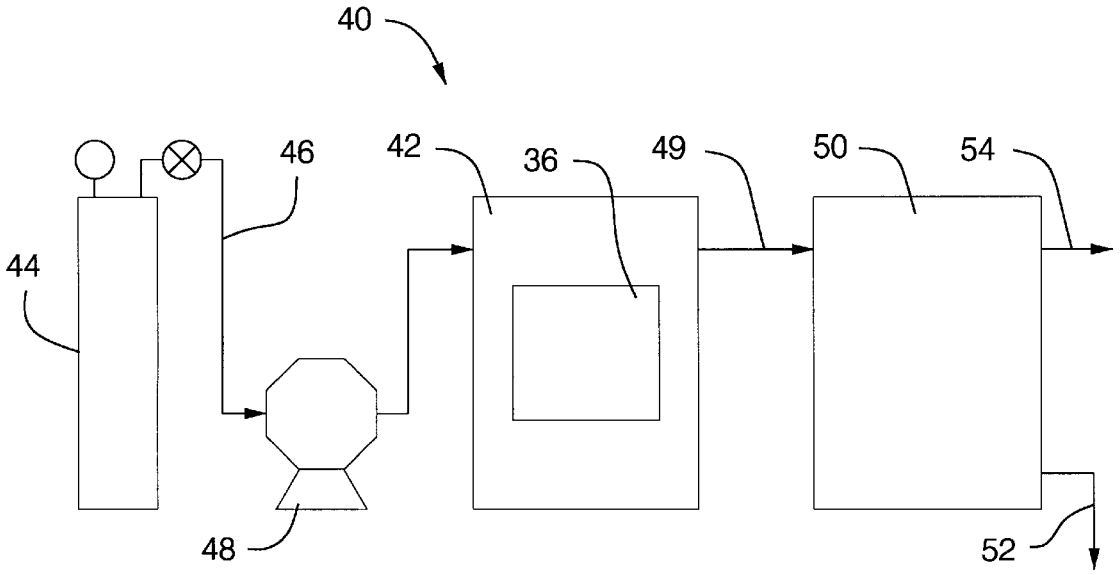
FIG. 3 is a schematic view of the pattern and shell mold in the treatment chamber of a supercritical carbon dioxide fluid extraction apparatus.

As soon as the shell mold has been dried, cured or otherwise prepared in a suitably rigid condition, the shell mold 36 and enclosed pattern are then placed in the extraction chamber 42 of a commercially available supercritical fluid (SCF) extraction apparatus 40 for extraction with supercritical carbon dioxide fluid. This process step is illustrated in FIG. 3 of the drawings. Liquid carbon dioxide is provided in tank 44. $CO_2$ liquid flows from tank 44 through line 46 into the inlet of pump 48. Liquid $CO_2$ under high pressure is pumped into chamber 42 where it is heated to a supercritical fluid. Air is expelled. The carbon dioxide is heated to a suitable temperature and pressure, for example, 35° C. and 1200 to 3000 psi. The relatively high pressure, supercritical carbon dioxide fluid surrounds and completely penetrates, wets and permeates both the shell mold 36 and the pattern structures. However, the supercritical carbon dioxide fluid dissolves or extracts only the diphenyl carbonate constituent of the pattern binder material. The dissolution and removal of the diphenyl carbonate also promotes removal of the polyethylene glycol at the completion of the brief treatment, typically one hour but varying with part size and percent of binder on aggregate. The shell mold structure is unaffected, but the aggregate particles of the pattern have now been stripped of their adhesive binder.

The high pressure $CO_2$ and entrained binder are removed from extractor chamber 42 via line 49 to separation chamber 50. As the pressure on the $CO_2$ in chamber 50 is lowered, the binder material separates from the $CO_2$ phase. The binder mixture is recovered as indicated at 52. Lower pressure $CO_2$ is vented as indicated at 54 for recompression and reuse.

Figure 4:
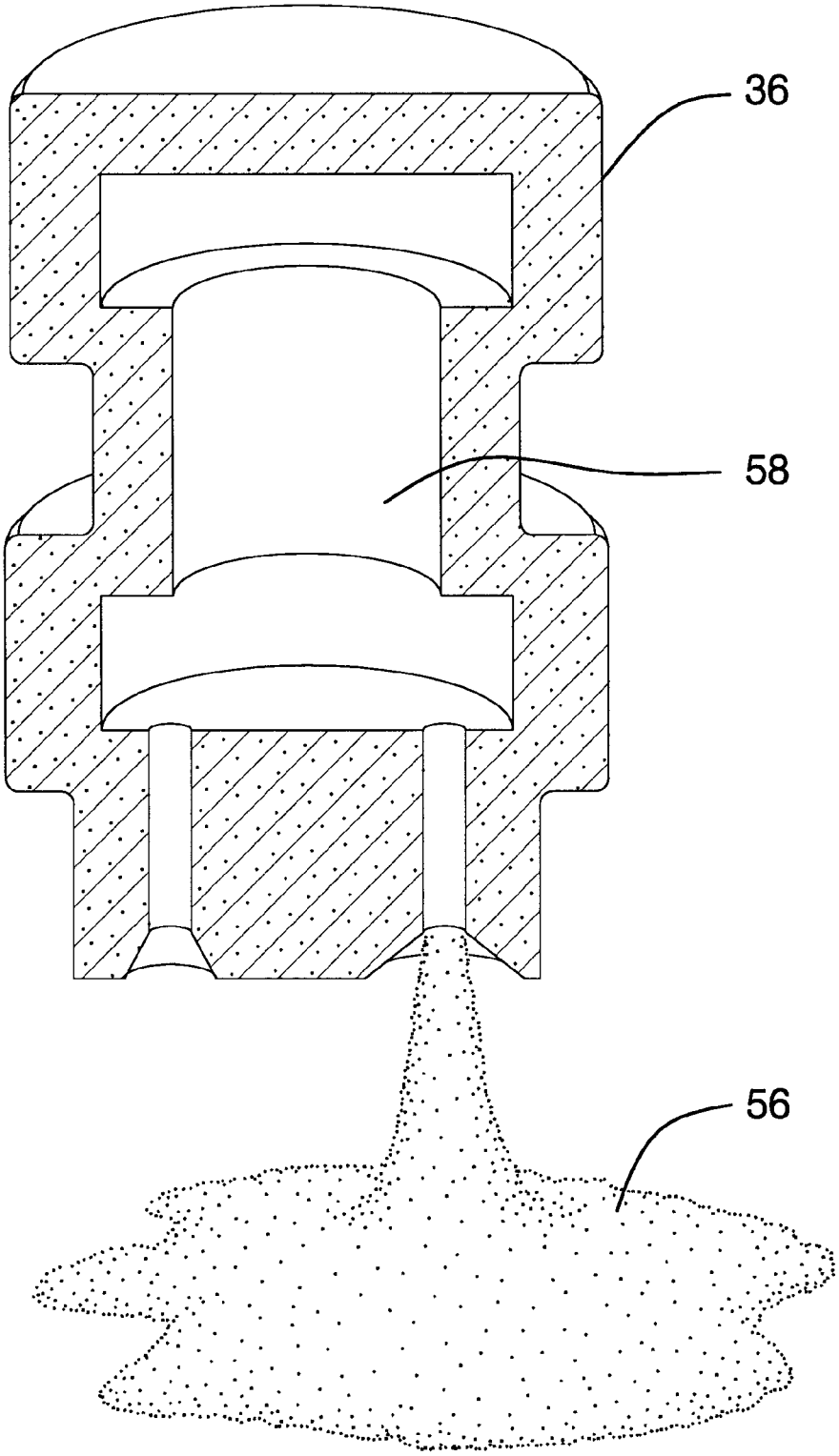
FIG. 4 is a schematic view of the sand mold being emptied of the pattern by pouring the unbonded aggregate particles from the mold.

The shell mold and enclosed unbonded aggregate particles are removed from a vented carbon dioxide extractor chamber 42. Once removed, the unbonded particles 56 (FIG. 4) can simply be drained by gravity or blown with a low pressure air stream from the shell mold 36. At the completion of this practice, a shell mold has then been prepared with cavity 58 which accurately defines the shape of a cast body to be prepared. The entire process can be completed in a few hours or a day or two. The pattern making process uses inexpensive binder and aggregate materials, and both materials are retained for reuse. The binder is recovered simply by evaporating the carbon dioxide solvent and the residual binder material removed from the extraction apparatus. The carbon dioxide can also be recaptured and recompressed for later reuse. The polyethylene glycol-diphenyl carbonate mixture can be reformulated, if necessary, and reused.

The shell mold can then be supported as desired by well known foundry practices and employed as the mold for casting any desired metal such as steel or cast iron alloys, aluminum alloys, magnesium alloys or the like.

As inferred above, a mixture of suitable binder constituents enables (1) the coating of aggregate particles, (2) the bonding of the coated particles into a suitable pattern configuration for mold preparation, and (3) the subsequent extraction of the binder with carbon dioxide SCF from the pattern particles without damage to the mold. The two part (or more parts) binder must have the described solubility characteristics in $CO_2$ SCF and the binder strength to hold the aggregate particle patterns together during mold making. The binder must also have a suitable viscosity to accomplish all of the above requirements.

Figure 5:
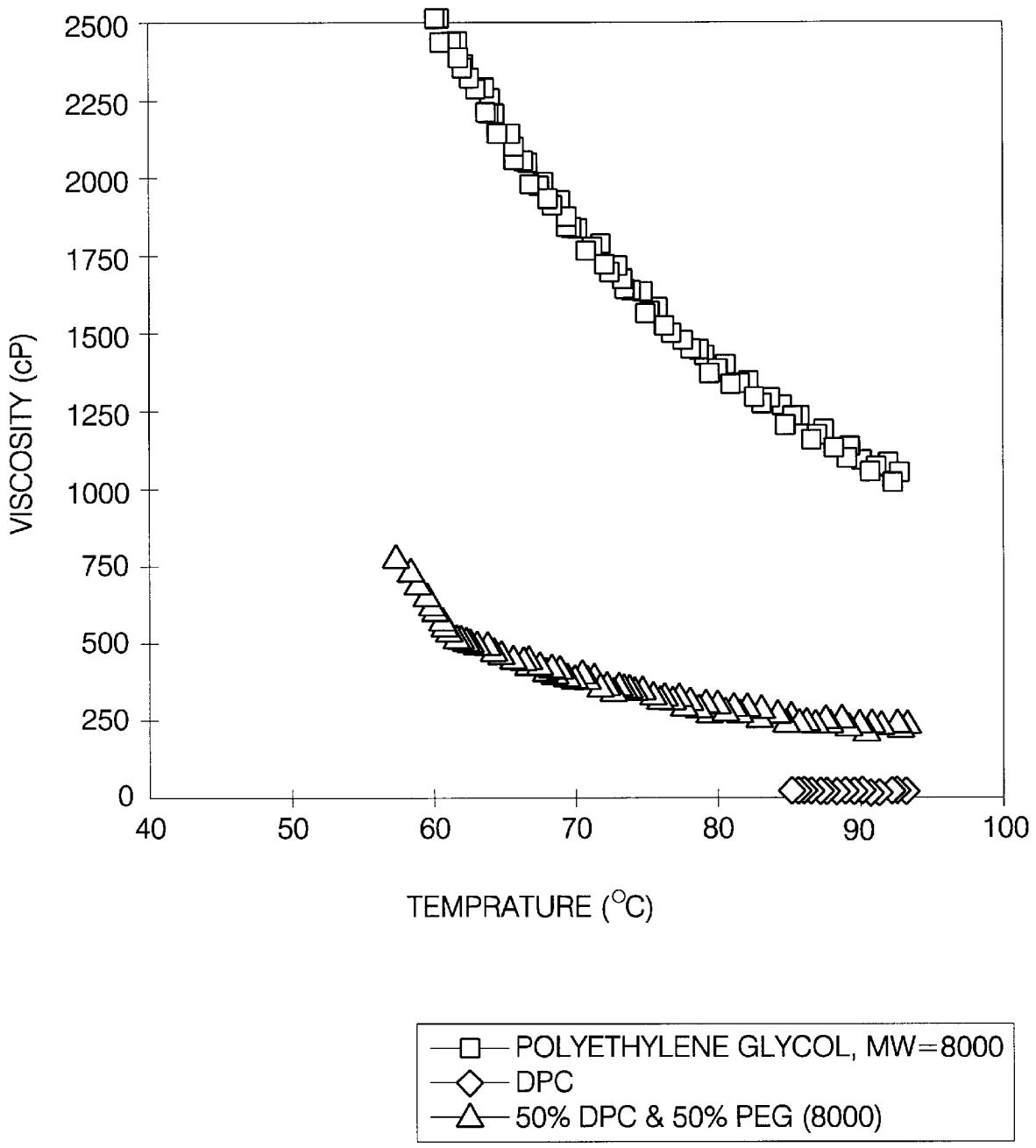
FIG. 5 is a set of viscosity vs. temperature curves for individual binder components and the components mixed at the proper ratio to form a binder composition.

FIG. 5 is a graph of viscosity (in centipoise, CP) versus temperature (° C.) for molten diphenyl carbonate (DPC, -open diamond-), polyethylene glycol, mw=8000 (PEG, -□-), and a mixture (-Δ-) of 50 percent by weight of each of DPC and PEG. It is seen that the viscosity of DPC is too low for coating and remaining on aggregate particles. However, the mixture of DPC and PEG displays a particularly suitable viscosity for the particle coating operations and particle bonding operations contemplated in preferred embodiments of this invention.

It will be recognized that a pattern could also be formed from the polyethylene glycol-diphenyl carbonate mixture itself. A body of this material could be formed and then cut to shape by a numerically-controlled machining operation. A mold could be built up around the resultant polyethylene glycol-diphenyl carbonate pattern thus formed. However, this practice forms a nonporous pattern which requires more extraction effort. In general, it is preferred to use the diphenyl carbonate-polyethylene glycol binder aggregate particles for the practice of making the pattern.

While the invention has been described in terms of a specific embodiment thereof, it will be appreciated that other forms could readily be adapted by those skilled in the art. Accordingly, the invention is intended to be limited only by the scope of the following claims.

What is claimed is:

1. A method of making a mold for casting a metal article comprising coating aggregate particles with a meltable binder film of a composition that is extractable in supercritical carbon dioxide fluid, shaping a volume of said particles into a casting pattern representing said article by temporarily melting said binder film on adjacent particles to adhesively join said particles in the shape of said pattern, forming a rigid mold around said pattern, said mold being formed of materials that are not soluble in supercritical carbon dioxide fluid, contacting said mold and pattern with carbon dioxide maintained at a supercritical temperature and pressure to selectively extract the binder film from the aggregate particles constituting said pattern and removing the unbonded aggregate particles from said mold to leave a casting cavity therein faithfully duplicating said pattern.

2. A method as recited in claim 1 in which said binder film composition comprises a first constituent that is soluble in supercritical carbon dioxide and a second constituent that is insoluble in supercritical carbon dioxide, the proportions of said first and second constituents being such that said binder film is extractable in supercritical carbon dioxide fluid.

3. A method as recited in claim 2 in which said first constituent of said binder film material comprises at least one of diphenyl carbonate and naphthalene.

4. A method as recited in claim 1 in which the composition of said binder film comprises diphenyl carbonate and a binder material selected from the group consisting of polyethylene glycol and polystyrene.

5. A method as recited in claim 4 in which said polyethylene glycol has a molecular weight in the range of about 2,000 to 20,000.

6. A method as recited in claim 4 in which said polystyrene has a molecular weight in the range of about 1000 to 5000.

7. A method as recited in any of claims 2 through 6 in which said binder film material comprises fifty percent by weight or more of diphenyl carbonate and/or naphthalene.

* * * * *